US006199816B1

(12) United States Patent
Case

(10) Patent No.: US 6,199,816 B1
(45) Date of Patent: Mar. 13, 2001

(54) ADJUSTABLE STORABLE BOOK HOLDER

(76) Inventor: Connie S. Case, 70 Shipyard Dr., Evian #106, Hilton Head, SC (US) 29928

( * ) Notice: Subject to any disclaimer, the term of this patent is extended or adjusted under 35 U.S.C. 154(b) by 0 days.

(21) Appl. No.: 09/270,721

(22) Filed: Mar. 17, 1999

(51) Int. Cl.[7] ..... A47B 97/04
(52) U.S. Cl. ..... 248/460; 108/233; 108/290
(58) Field of Search ..... 248/460, 444.1, 248/446, 447, 454, 455, 457, 461, 444, 463; 312/233, 227, 328, 290

(56) References Cited

U.S. PATENT DOCUMENTS

| | | | | |
|---|---|---|---|---|
| D. 358,611 | * | 5/1995 | Danoff et al. | D19/88 |
| 2,489,553 | * | 11/1949 | Wofford | 45/80 |
| 2,795,473 | * | 6/1957 | Smith | 312/295 |
| 2,934,388 | * | 4/1960 | Brown | 312/233 |
| 3,762,675 | | 10/1973 | Sankey | 248/464 |
| 3,809,352 | | 5/1974 | Mathias | 248/451 |
| 3,883,108 | | 5/1975 | Swartz | 248/460 |
| 4,120,564 | | 10/1978 | Rios | 350/241 |
| 4,121,361 | | 10/1978 | D'Arcy | 40/470 |
| 4,239,171 | | 12/1980 | Huls et al. | 248/558 |
| 4,496,127 | | 1/1985 | Nelson | 248/444.1 |
| 4,552,382 | | 11/1985 | Cowden | 281/45 |
| 4,629,264 | * | 12/1986 | Culver | 312/223 |
| 4,685,647 | | 8/1987 | Calhoun | 248/444.1 |
| 4,998,703 | * | 3/1991 | Stewart | 248/447 |
| 5,409,383 | * | 4/1995 | Mannino | 434/414 |
| 5,671,901 | * | 9/1997 | Jacober | 248/452 |

* cited by examiner

*Primary Examiner*—Anita M. King
*Assistant Examiner*—Kimberly Wood
(74) *Attorney, Agent, or Firm*—Harleston Law Firm; Kathleen M. Harleston

(57) ABSTRACT

An adjustable, storable holder for supporting a book or other article to be read or viewed in an open position is provided. The holder comprises: (a) a generally rectangular shaped base member with an upper surface having a series of peg holes in sets of two; (b) from about two to 20 pegs of at least two lengths, with at least two pegs of each length; (c) a viewing member which is hinged to the upper surface of the base member, and which has a central transparent panel; and (d) a compartment in the base member for storage of the pegs. The holder has an open position in which at least two matched pegs project from the upper surface, and support the reading article. The viewing member rests relatively flat against the pages of the reading article and at an angle to the upper surface when the holder is in use. The holder has a closed position for storage of the holder, in which the viewing member lies flat against the upper surface of the base member. One side of the viewing member can be temporarily lifted so that the user may turn to another page without removing the reading article from the holder.

11 Claims, 4 Drawing Sheets

ADJUSTABLE STORABLE BOOK HOLDER

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Technical Field

The present device is an adjustable holder for supporting a book, magazine, recipe card, or the like, which can be folded for storage. It preferably includes a transparent, flat magnifying panel.

2. Background Information

There are currently available holders and stands for supporting books and other reading material. One problem that is not solved by currently available book stands, though, is the problem of having to stop reading and remove the book from the stand in order to turn the page. This can be cumbersome and inconvenient where, for example, the person is cooking or doing a craft according to instructions being held by the book holder, and their hands are sticky or dirty. This problem is solved by the present invention, which has a hinged viewing member that can be moved toward or away from the book by the user. With the present device, the reader need only lift the viewing member with one hand, turn the page, and push the viewing member back down on the fresh page or pages. The user need not stop in mid-operation, perhaps with soiled hands, to remove the book, turn the page, and reinsert the book one or more times.

Another advantage of the present holder is that it can accommodate books, magazines, and other reading materials of varying thicknesses. By choosing shorter or longer pegs to support the reading article, and positioning the pegs in peg holes which are closer to or farther from the reading article, the present holder may be used to support a thick book, a flexible magazine, or a single recipe card, for example. Along with protecting the reading article from spatters, the viewing member of this invention preferably magnifies the words on the page for greater legibility from a distance. The holder of the present invention is also unique in that it folds into a book-like shape for easy storage on, for example, a shelf.

BRIEF SUMMARY OF THE INVENTION

The present invention is an adjustable, storable holder for supporting a book or other article to be read or viewed in an open position. The holder comprises:

(a) a generally rectangular shaped base member, the base member having an upper surface with four sides, the upper surface comprising between about two and twenty peg holes in lines along the upper surface, the peg holes being in sets of two;

(b) between about two and twenty pegs, the pegs being of at least two lengths, with at least two pegs of each length, the pegs having at least one end with a diameter that matches the diameter of the peg holes in the upper surface of the base member;

(c) a viewing member which is hinged at one side to one side of the upper surface of the base member, the viewing member comprising a central transparent panel, the transparent panel being generally parallel to and pressed up against the reading article when the holder is in use, thus facilitating a user's view of the reading article;

(d) a hinge mechanism for hinging the viewing member to the base member; and (e) a compartment in the base member for storage of the pegs when they are not in use. (These are preferably in combination.) The holder has a hands-free, open position in which at least two matched pegs project from a matched set of peg holes in the upper surface. Each set of pegs is generally parallel to each other, with one end of each peg removably inserted in a peg hole and the other end of each peg engaged against a back side of the reading article. The reading article is supported by the pegs in the upper surface. In the open position, the viewing member is at an angle to the upper surface, and a bottom edge of the reading article rests between the hinged side of the viewing member and the corresponding side of the upper surface. The holder also has an alternate closed position for storage of the holder, in which the viewing member lies flat against a substantial portion of the upper surface of the base member.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
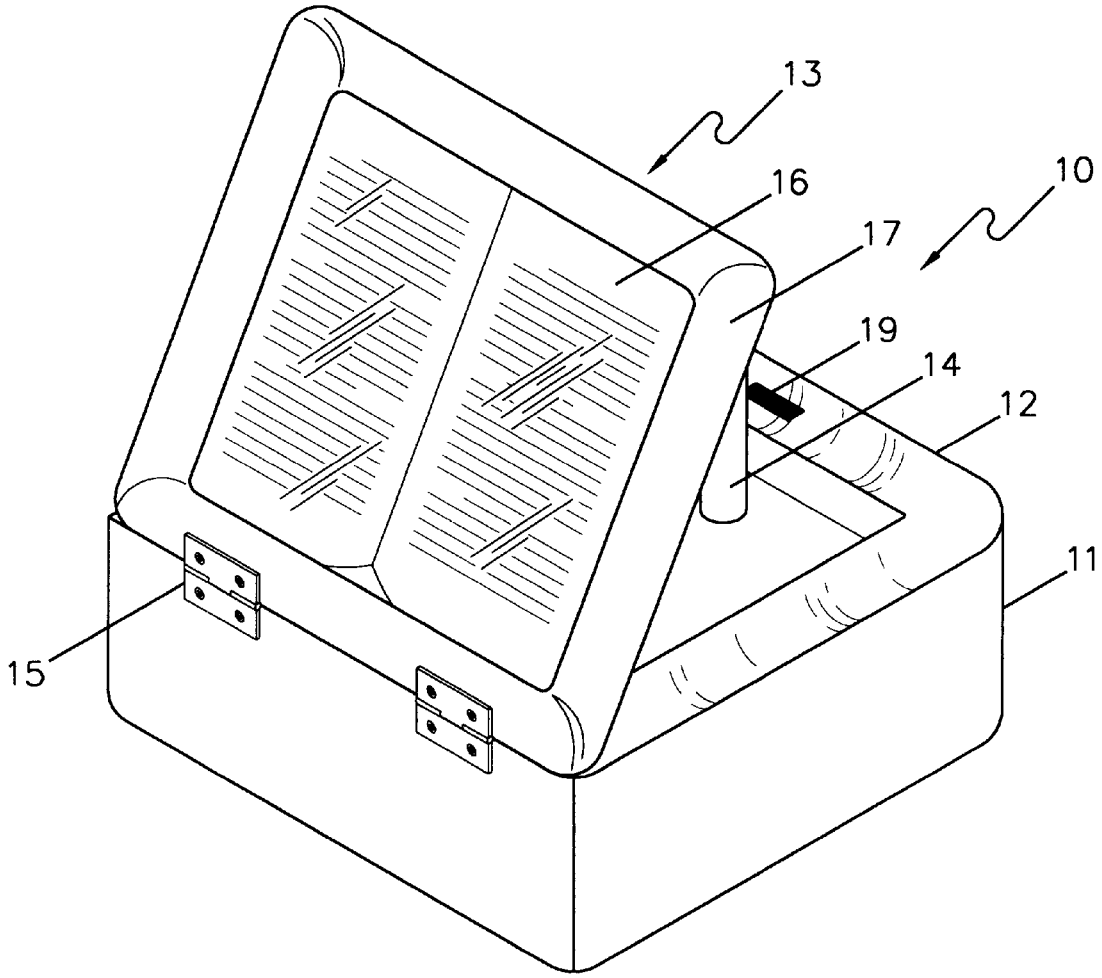
FIG. 1 is a perspective view of a book holder according to the present invention, shown from the front of the holder.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Referring to FIG. 1, an adjustable, storable holder 10 according to the present invention is shown in an open position supporting a book for easy, hands-free reading by a person sitting or standing a certain distance from the book. The holder may be placed on, for example, a desk, table, or counter in front of the user, and the article to be read or viewed will be held at an angle by the holder so that it can be read comfortably by the user. The holder 10 comprises a generally rectangular shaped (preferably square) base member 11 having an upper surface 12, a relatively flat viewing member 13 which is hinged along one side to an edge of the upper surface of the base member, and pegs 14. Here, there are two conventional hinges 15, most preferably steel-brass plated, but any suitable hinging mechanism may be employed. The pegs 14 engage and support the back of the reading article. The viewing member 13 comprises a transparent panel 16, preferably one with magnifying properties to enlarge the words on the pages being read. The transparent panel is generally parallel to and pressed up against the reading article when the holder is in use, thus facilitating viewing of the reading article by a person standing or sitting a certain distance away from the reading article. In this preferred embodiment, the transparent, preferably glass, panel 16 is supported and protected by a frame member 17 around its four sides. The comers of the frame member 17 and the base member 11 are preferably rounded for safety and easier cleaning. A magnetic lock member 19 on the edge of the upper surface is shown.

Figure 2:
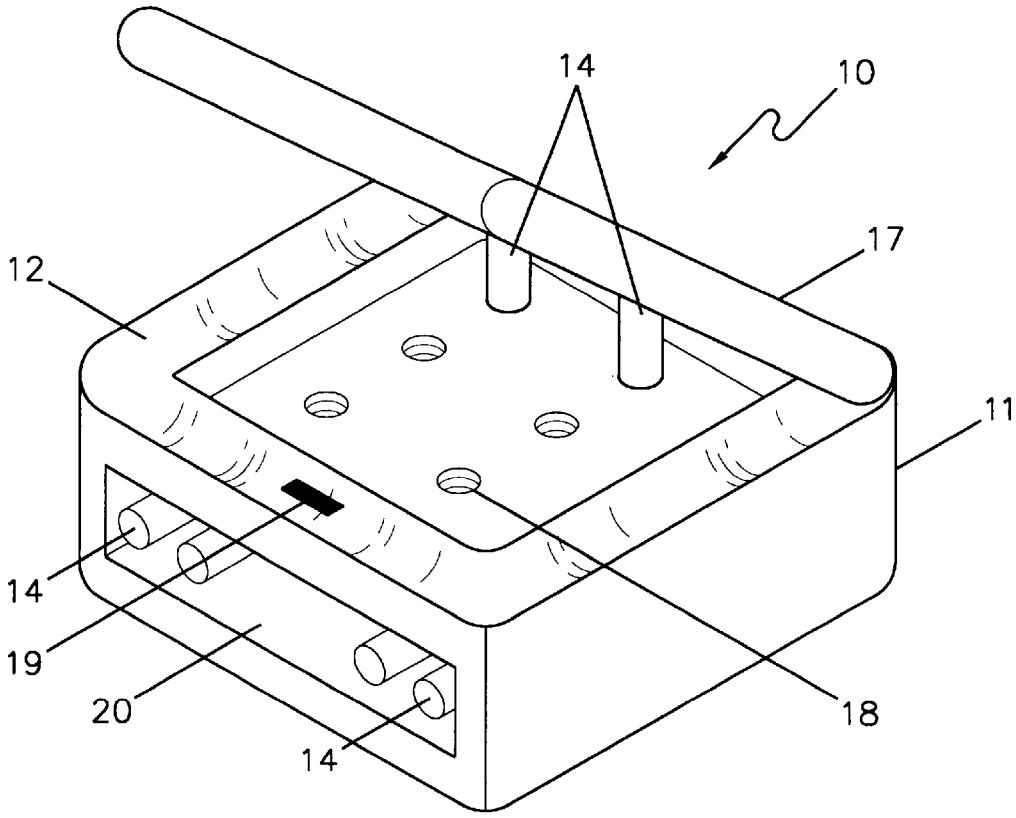
FIG. 2 is a perspective view of a book holder according to the present invention, shown from the rear of the holder.

FIG. 2 shows the holder 10 from a rear perspective and in an open position. The upper surface 12 comprises between about two and twenty peg holes 18. There are preferably six, eight, or ten relatively round peg holes in the upper surface of the base member, and all of the peg holes preferably have the same diameter and depth. Here, six peg holes are shown. The peg holes 18 occur along the upper surface in lines and in sets of two. When the holder is in an open position, at least two pegs project from a set of corresponding peg holes in the upper surface of the base member. The pegs are of at least two lengths, with at least two pegs of each length. The pegs have at least one end with a diameter that matches the diameter of the peg holes in the upper surface of the base member. Each set of pegs is parallel to each other, and preferably perpendicular to the upper surface of the base member, with one end of each peg removably inserted in a peg hole and the other end of each peg contacting the back of the reading article.

By "reading article" is meant an article for reading or viewing, such as one or two pages of a book, magazine, recipe card, instruction manual or sheet, drawing or pattern to be copied, or a photograph to be painted, or any other written or drawn material that a person might wish to read or view. By "storable" is meant the holder can be folded to the closed position for easy storage. This is advantageous because the book holder need not be left out on the counter or desk, taking up space even when it is not in use. Instead, it can easily be closed and stored on a shelf, and easily opened again for use later.

When the holder is in use, the reading article is supported by the pegs, and the viewing member rests flat against the page or pages of the reading article and at an angle to the upper surface. This angle varies according to the length of the pegs used, the distance the pegs are from the hinged side of the viewing member, and the thickness of the reading material. Unlike many available holders, this one can be adjusted according to the thickness (number of pages) and size of the reading article. The angle usually varies between about 30 degrees and about 80 degrees. The bottom edge of the reading article rests between the hinged edge of the viewing member and the corresponding edge of the upper surface. Thus, the base supports some of the weight of the reading article.

The peg holes are preferably threaded, as are the ends of the pegs. The peg holes are most preferably between about ½ and 3 inches in depth, and about ⅛ and ½ inch in diameter. The peg holes preferably all have the same diameter. The holder is preferably substantially comprised of wood or plastic. The holder in the closed position most preferably measures between about 10 and 12 inches in length and width, and about 4 and 6 inches in width.

In FIG. 2, two short pegs 14 of equal length have been placed in the peg holes closest to the hinged edge of the viewing member, because the reading material is small and thin, e.g., an index or recipe card. The holder preferably includes pegs of three different lengths, the differences between the lengths varying between ½ and three inches. The user preferably uses the shorter pegs in peg holes which are closer to the reading article for supporting relatively thin (less than about ½ inch wide) reading articles, and the longer pegs in peg holes which are farther from the reading article for relatively thick (more than about an inch wide; i.e., many pages) reading articles. For example, pegs would be placed in the peg holes furthest from the hinged edge of the viewing member for a large, two inch thick book. By choosing shorter or longer pegs and peg holes closer to or farther away from the reading material, the user adjusts the holder to suit the size and thickness of the reading material. In addition to holding traditional reading material such as books, magazines, sheets of instructions, recipe cards and the like, this holder may be used to hold a drawing or photograph for assisting an artist, for example, to paint a picture using the drawing or photo for reference.

The unhinged side of the viewing member can be temporarily lifted with one hand so that pages in the reading article may be turned without removing the reading article from the holder. This is advantageous because the user can keep using the other hand for continuing the craft, baking, drawing, or other activity underway. A rachet style of hinge mechanism may be utilized which will maintain the viewing member in one position until it is moved by the user. This way, a minimal, one-handed effort is required to turn the page. To turn the page, the user lifts the free (unhinged) edge of the viewing member, turns the page with the same hand, and then pushes the viewing member back down on the reading material so the material is again legible. The viewing member stays in place because of the racheting hinge mechanism. The user need not stop what he or she is doing to lift the reading material out of the holder, turn the page and put it back in.

As shown in FIG. 2, three of the edges of the upper surface 12 are beveled for receiving the frame 17 of the viewing member when the holder is closed. The central part of the upper surface, which holds the peg holes 18, is slightly recessed. The holder 10 further comprises a magnetic lock mechanism 19, which has one member on one side of the viewing member and an opposite member on the corresponding side of the upper surface. The members of the magnetic lock mechanism are engaged when the holder is closed for storage. In FIG. 2, a magnetic lock member 19 on the edge of the upper surface is shown. The bottom edge of the frame member holds the corresponding member of the magnetic lock mechanism (not shown). When the holder is folded (closed), the pegs have been removed from the upper surface, and the viewing member is pushed down to meet a substantial portion of the upper surface. The two members of the magnetic lock then fasten to each other and hold the holder closed until the next use. A more traditional locking mechanism may be employed.

As can be seen in FIG. 2, the holder preferably further comprises a rectangular-shaped compartment 20 at the back of the base member. Preferably, the peg compartment 20 is open and comprises relatively round peg holes of the same diameter and depth as the peg holes in the upper surface. The pegs 14 which are not in use at the time are stored in the compartment, with one peg in each peg hole. To use the pegs, the user unscrews the selected pegs from peg holes in the peg compartment, and then screws the pegs into the appropriate peg holes on the upper surface.

Figure 3:
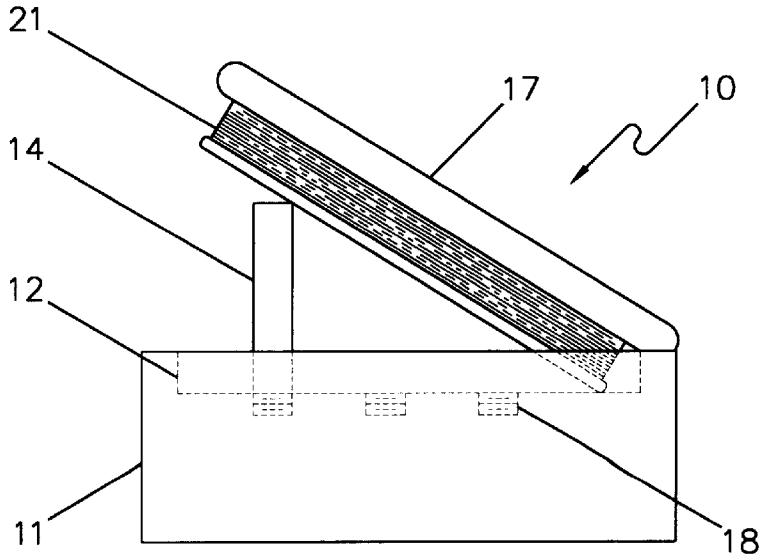
FIG. 3 is a side elevational view of the book holder shown in FIG. 1.

In FIG. 3, the holder 10 can be seen from the side. The recessed upper surface 12 with three peg holes 18 can be seen. A longer peg 14 is in the peg hole 18 which is furthest from the hinged edge. The pegs are seen to support a relatively thick book 21.

Figure 4:
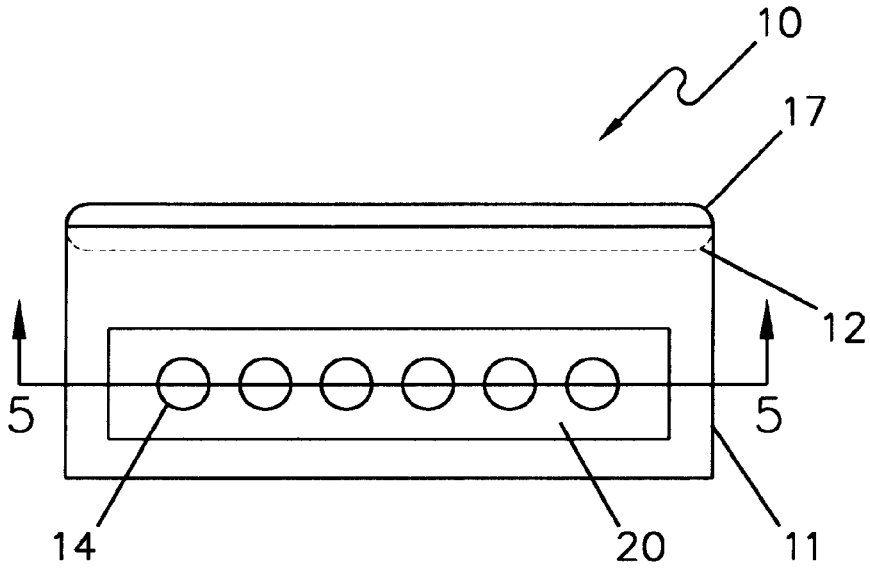
FIG. 4 is a rear elevational view of a book holder according to the present invention, in a closed position.

FIG. 4 is an elevational view of the back of the holder 10 in the closed position. The holder has a closed position for storage in which the viewing member lies flat against at least a portion of the upper surface of the base member holder. In this closed position, the holder resembles a book and may be stored, for example, on end on a bookshelf. The frame member 17 protects the transparent member 16 from being scratched by books or other items adjacent to the holder on the shelf. In FIG. 4, the rectangular-shaped compartment 20 holds six pegs 14. The present invention preferably includes two pegs 14 each of three lengths: 3, 5 and 7 inches.

Figure 5:
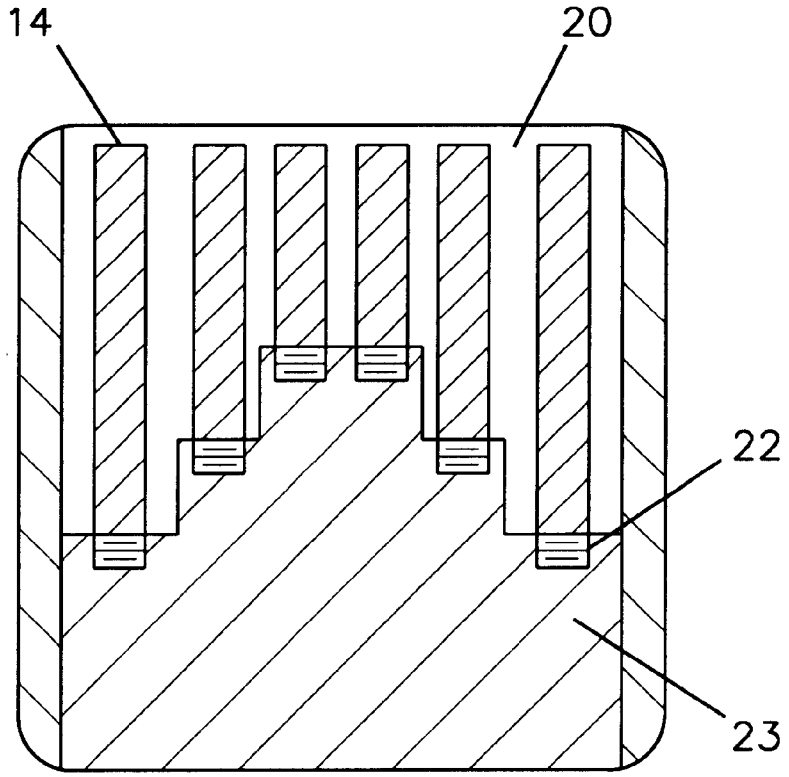
FIG. 5 is a cross-sectional view of the book holder shown in FIG. 4, taken along line 5—5 in FIG. 4.

FIG. 5 shows a cross-sectional view of the holder 10 taken along line 5—5 in FIG. 4. The three lengths of pegs 14 are screwed into peg holes 22 in the storage compartment 20. The peg holes 22 in the storage compartment are in a compartment base 23 which is stair-stepped so that the free ends of the pegs are all flush and accessible to the user. Here, the two shortest pegs are in the interior of the compartment. The longest pegs are on either end of the compartment. The user selects two same-length pegs for use and unscrews them from the compartment. The user then screws the two pegs 14 into the peg holes 18 in the upper surface 12 of the holder.

Figure 6:
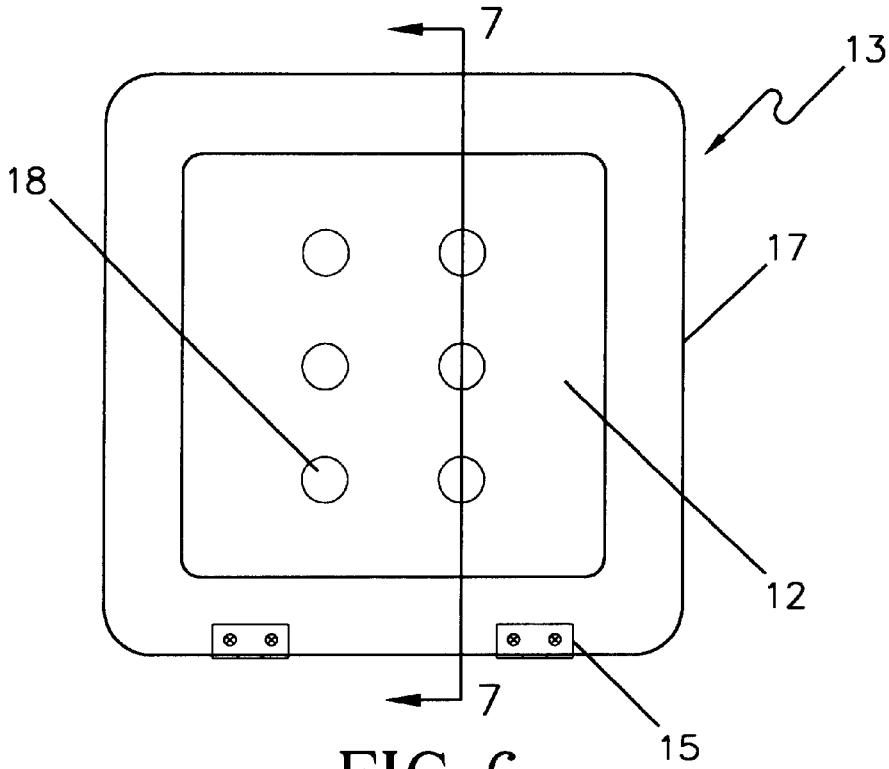
FIG. 6 is a plan view of the book holder shown in FIG. 4.

FIG. 6 is a plan view of the top of the holder 10 in the closed position. The peg holes 18 are visible through the transparent glass 16 in the viewing member 13. The frame member 17 surrounds the transparent glass.

Figure 7:
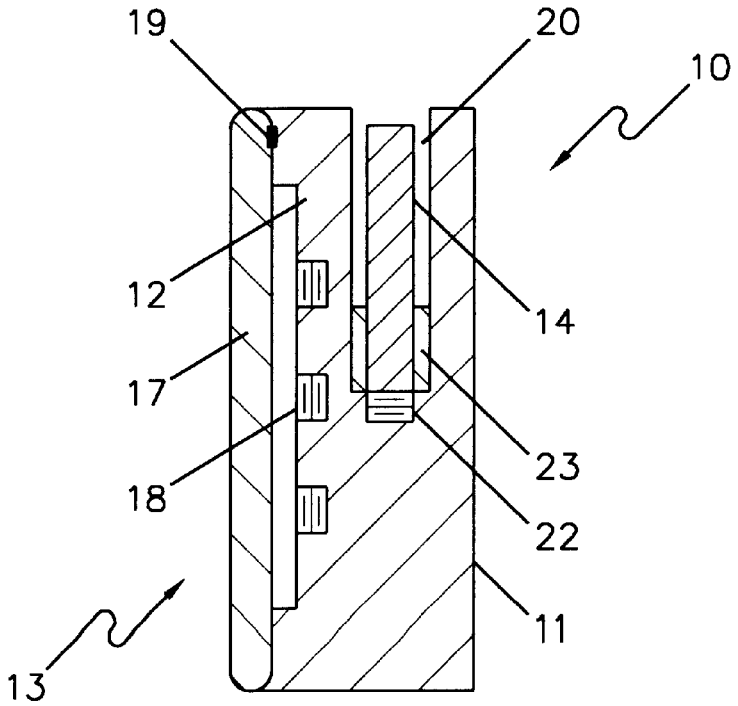
FIG. 7 is a cross-sectional view of the book holder shown in FIG. 6, taken along line 7—7 in FIG.6.

FIG. 7 shows a cross-sectional view of the holder 10 taken along line 7—7 in FIG. 6. The closed holder is shown ready for storage on a book shelf, with the open peg compartment 20 at the top. For storage, the peg compartment could alternatively face down. The pegs 14 will not fall out because they are secured in the peg compartment 20. In FIG. 7, the compartment holds a peg 14, which is screwed into a compartment peg hole 22. The stepped compartment base 23 can be seen behind the peg 14. To the left of the drawing is the viewing member 13, which includes frame member 17. The viewing member 13 is locked against the upper surface of the base member via the magnetic lock 19. The recessed portion of the upper surface holds the peg holes 18. To the right of FIG. 7, the base member 11 is shown.

From the foregoing it can be realized that the described device of the present invention may be easily and conveniently utilized as a holder for reading or artistic material. While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

Brief List of Reference Numbers Used in the Drawings

10 holder
11 base member
12 upper surface of base member
13 viewing member
14 peg
15 hinge
16 transparent panel
17 frame member
18 upper surface peg hole
19 magnetic lock member
20 peg compartment
21 book
22 compartment peg hole
23 stepped compartment base

What is claimed is:

1. An adjustable, storable holder for supporting a book or other article to be read or viewed in an open position, the holder comprising:

(a) a generally rectangular shaped base member, the base member having an upper surface with four sides, the upper surface comprising between about two and twenty peg holes in lines along the upper surface, the peg holes being in sets of two;

(b) between about two and twenty pegs, the pegs being of at least two lengths, with at least two pegs of each length, the pegs having at least one end with a diameter that matches the diameter of the peg holes in the upper surface of the base member;

(c) a viewing member which is hinged at one side to one side of the upper surface of the base member, the viewing member comprising a central transparent panel, the transparent panel being generally parallel to and pressed up against the reading article when the holder is in use, thus to facilitate viewing of the reading article by a user standing or sitting nearby;

(d) a hinge mechanism for hinging the viewing member to the base member; and (e) a compartment in the base member for storage of the pegs when they are not in use; and wherein the holder has a hands-free, open position in which at least two matched pegs project from a matched set of peg holes in the upper surface, each set of pegs being generally parallel to each other, with one end of each peg removably inserted in a peg hole and the other end of each peg engaged against a back side of the reading article, the reading article being supported by the pegs, the viewing member resting relatively flat against one or two pages of the reading article and at an angle to the upper surface, a bottom edge of the reading article resting between the hinged side of the viewing member and the corresponding side of the upper surface;

wherein the holder has an alternate closed position for storage of the holder, in which the viewing member lies flat against a substantial portion of the upper surface of the base member; and wherein a side of the viewing member opposite to the hinged side can be temporarily lifted with one hand so that the user may then turn to another page in the reading article without removing the reading article from the holder.

2. A holder according to claim 1, wherein the transparent panel has magnifying properties for facilitating reading or viewing of the reading article.

3. A holder according to claim 2, wherein the holder includes pegs of three different lengths, the differences between the lengths varying between ½ and three inches, and wherein the holder has the shorter pegs in the upper surface peg holes which are closer to the reading article when relatively thin reading articles are being supported, and the longer pegs in the upper surface peg holes which are farther from the reading article for relatively thick reading articles.

4. A holder according to claim 2, wherein there are six, eight, or ten relatively round peg holes in the upper surface of the base member, and all of the peg holes have the same diameter and depth.

5. A holder according to claim 4, wherein the compartment is open and comprises relatively round peg holes of the same diameter and depth as the peg holes in the upper surface, and wherein the pegs which are not in use are stored in the compartment, with one peg in each peg hole.

6. A holder according to claim 5, wherein the holder is substantially comprised of wood or plastic.

7. A holder according to claim 6, wherein the holder comprises two pegs each of three lengths, each peg being 3, 5 or 7 inches long, and wherein the user uses 3 or 5 inch pegs for relatively thin reading articles, and 5 or 7 inch pegs for relatively thick reading articles.

8. A holder according to claim 7, wherein the viewing member further comprises a frame member around the transparent panel.

9. A holder according to claim 8, wherein the holder in the closed position measures between about 10 and 12 inches in length and width, and about 4 and 6 inches in width.

10. A holder according to claim 9, wherein the peg holes are threaded and between about ½ and 3 inches in depth and between about ⅛ and ½ inch in diameter.

11. A holder according to claim 10, further comprising a magnetic lock mechanism, the magnetic lock mechanism having one member on one side of the viewing member and an opposite member on the corresponding side of the upper surface, wherein members of the magnetic lock mechanism are engaged when the holder is closed for storage.

* * * * *